US011926970B2

(12) United States Patent
Brown

(10) Patent No.: US 11,926,970 B2
(45) Date of Patent: Mar. 12, 2024

(54) ARTIFICIAL TURF SYSTEM INCLUDING A GEOGRID AND AN EXISTING TURF

(71) Applicants: APT Advanced Polymer Technology Corp., Harmony, PA (US); Polytex Sportbelage Produktions-GmbH, Grefrath (DE)

(72) Inventor: Kris Brown, Dalton, GA (US)

(73) Assignee: APT Advanced Polymer Technology Corp., Harmony, PA (US)

( * ) Notice: Subject to any disclaimer, the term of this patent is extended or adjusted under 35 U.S.C. 154(b) by 563 days.

(21) Appl. No.: 16/621,541

(22) PCT Filed: Dec. 7, 2018

(86) PCT No.: PCT/EP2018/083939
§ 371 (c)(1),
(2) Date: Dec. 11, 2019

(87) PCT Pub. No.: WO2019/110784
PCT Pub. Date: Jun. 13, 2019

(65) Prior Publication Data

US 2020/0291582 A1 Sep. 17, 2020

Related U.S. Application Data

(60) Provisional application No. 62/595,747, filed on Dec. 7, 2017.

(30) Foreign Application Priority Data

Mar. 9, 2018 (EP) ..... 18161111

(51) Int. Cl.
*E01C 13/08* (2006.01)
*E01C 13/02* (2006.01)
*D06N 7/00* (2006.01)

(52) U.S. Cl.
CPC ..... *E01C 13/08* (2013.01); *E01C 13/02* (2013.01); *D06N 7/0065* (2013.01);
(Continued)

(58) Field of Classification Search
CPC ..... E01C 13/08; E01C 13/02; E01C 2201/20; E01C 23/065; D06N 7/0065; D06N 7/0071; D10B 2505/202; Y10T 428/23914
(Continued)

(56) References Cited

U.S. PATENT DOCUMENTS 6,877,932 B2 4/2005 Prevost
2003/0039511 A1 2/2003 Prevost
(Continued)

FOREIGN PATENT DOCUMENTS

JP S53-142025 A 12/1978
JP H5-156603 A 6/1993
(Continued)

OTHER PUBLICATIONS

JP 2012-132274 issued to Horio et al., 2012, Google Patents translation.*
(Continued)

*Primary Examiner* — Cheryl Juska
(74) *Attorney, Agent, or Firm* — Harness, Dickey & Pierce, P.L.C.

(57) ABSTRACT

An artificial turf system (100) provides an existing artificial turf (102) including a plurality of existing artificial turf fibres (104) and an existing artificial turf backing (106) configured to carry the plurality of existing artificial turf fibres, a new artificial turf comprising a plurality of artificial turf fibres and an artificial turf backing layer, where the artificial turf backing layer comprises a carrier structure (302) configured to carry the plurality of artificial turf fibres,
(Continued)

and a geogrid (114) positioned between the existing artificial turf and the backing layer of the new artificial turf.

12 Claims, 5 Drawing Sheets

(52) U.S. Cl.
CPC .. *D10B 2505/202* (2013.01); *E01C 2013/086* (2013.01); *E01C 2201/20* (2013.01); *Y10T 428/23914* (2015.04)

(58) Field of Classification Search
USPC ..... 428/86
See application file for complete search history.

(56) References Cited

U.S. PATENT DOCUMENTS

| | | | | |
|---|---|---|---|---|
| 2003/0118755 | A1 | 6/2003 | Motz et al. | |
| 2004/0028841 | A1* | 2/2004 | Motz | E01C 13/08 428/17 |
| 2004/0247822 | A1* | 12/2004 | Foxon | E01C 13/08 428/95 |
| 2012/0064262 | A1 | 3/2012 | Ayers et al. | |
| 2016/0265170 | A1* | 9/2016 | Vachon | E01C 13/08 |
| 2020/0002900 | A1* | 1/2020 | Bissonnette | B32B 5/16 |
| 2021/0002832 | A1* | 1/2021 | Brown | E01C 13/02 |
| 2021/0230814 | A1* | 7/2021 | Sick | B32B 5/08 |

FOREIGN PATENT DOCUMENTS

| | | | |
|---|---|---|---|
| JP | 2533028 | B2 * | 9/1996 |
| JP | 2010-70987 | A | 4/2010 |
| JP | 2012-132274 | A | 7/2012 |
| JP | 2016-20574 | A | 2/2016 |
| WO | WO-01/96664 | A1 | 12/2001 |

OTHER PUBLICATIONS

International Preliminary Report and Written Opinion for PCT/EP2018/083939 dated Jun. 18, 2020.
International Search Report PCT/ISA/210 for International Application No. PCT/EP2018/083939 dated Feb. 19, 2019.
Written Opinion of the International Searching Authority PCT/ISA/237 for International Application No. PCT/EP2018/083939 dated Feb. 19, 2019.

* cited by examiner

ARTIFICIAL TURF SYSTEM INCLUDING A GEOGRID AND AN EXISTING TURF

CROSS-REFERENCE TO RELATED APPLICATIONS

This application is a national phase under 35 U.S.C. § 371 of PCT International Application No. PCT/EP2018/083939 which has an International filing date of Dec. 7, 2018, which claims priority to European Patent Application No. 18161111.2, filed Mar. 9, 2018, and U.S. Provisional Application No. 62/595,747, filed Dec. 7, 2017, the entire contents of each of which are hereby incorporated by reference.

RELATED REFERENCES

This application is related to international patent application number PCT/EP2015/058237, filed Apr. 16, 2015, which is incorporated herein by reference.

FIELD OF THE INVENTION

Certain embodiments of the invention relate to the field of artificial turf systems and methods of manufacture. More specifically, certain embodiments of the invention relate to an artificial turf system including a geogrid, and methods of utilizing exiting artificial turfs in the manufacture therein.

BACKGROUND OF THE INVENTION

Artificial turf or artificial grass is surface that is made up of fibres which is used to replace grass. The structure of the artificial turf is designed such that the artificial turf has an appearance which resembles grass. Typically, artificial turf is used as a surface for sports such as soccer, American football, rugby, tennis, golf, for playing fields, or exercise fields. Furthermore, artificial turf is frequently used for landscaping applications. An advantage of using artificial turf is that it eliminates the need to care for a grass playing or landscaping surface, like regular mowing, scarifying, fertilizing and watering. For example, watering can be difficult due to regional restrictions for water usage. In other climatic zones the re-growing of grass and re-formation of a closed grass cover is slow compared to the rate of damaging the natural grass surface by playing and/or exercising on the field.

Although artificial turf fields do not require similar attention and effort to be maintained, they typically exhibit wear after a usage time of 5-15 years. Mechanical damage from use and exposure to UV radiation, thermal cycling, interactions with chemicals and various environmental conditions generate wear on artificial turf. It is therefore beneficial, both economically and environmentally, to use an existing worn artificial turf as a base for manufacturing a new artificial turf system.

U.S. Pat. No. 6,877,932 to Prevost entitled "Drainage system and method for artificial grass using spacing grid" describes the use of an extruded polypropylene grid beneath a synthetic turf field US 2012/0064262 A1 describes a mechanically stabilized earth (MSE) walls and/or synthetic grass cover including alternating layers of granular fills and soil reinforcement geo-grids.

JP 2010 070987 A, 2 Apr. 2010 describes that an elastic force of a substrate layer is adjusted by providing an adjusting layer made of rigid particulate matter. The elastic particulate matter of the existing artificial lawn is made of an artificial long-pile lawn having the elastic particulate matter infilled between the long piles.

BRIEF SUMMARY OF THE INVENTION

Various embodiments provide a method for manufacturing an artificial turf system, an artificial turf system, and a machine for manufacturing an artificial turf system, as described by the subject matter of the independent claims. Advantageous embodiments are described in the dependent claims. Embodiments of the present invention can be freely combined with each other if they are not mutually exclusive.

In one aspect, the invention relates to a an artificial turf system, comprising an existing artificial turf including a plurality of existing artificial turf fibres and an existing artificial turf backing layer configured to carry the plurality of existing artificial turf fibres, a new artificial turf comprising a plurality of artificial turf fibres and an artificial turf backing layer, where the artificial turf backing layer comprises a carrier structure configured to carry the plurality of artificial turf fibres, and a geogrid positioned between the existing artificial turf and the backing layer of the new artificial turf.

In another aspect, the invention relates to a method for manufacturing an artificial turf system, comprising placing a geogrid on an existing artificial turf, and placing a new artificial turf on the geogrid, wherein the existing artificial turf comprises a plurality of existing artificial turf fibres and an existing artificial turf backing layer configured to carry the plurality of existing artificial turf fibres, wherein the new artificial turf comprises a plurality of artificial turf fibres and an artificial turf backing layer. The artificial turf backing layer comprises a carrier structure configured to carry the plurality of artificial turf fibres. The new artificial turf is placed on the geogrid layer such that the backing layer of the new artificial turf is adjacent to the geogrid.

BRIEF DESCRIPTION OF SEVERAL VIEWS OF THE DRAWINGS

The following embodiments of the invention are explained in greater detail, by way of example only, making reference to the drawings in which.

DETAILED DESCRIPTION OF THE INVENTION

Figure 1:
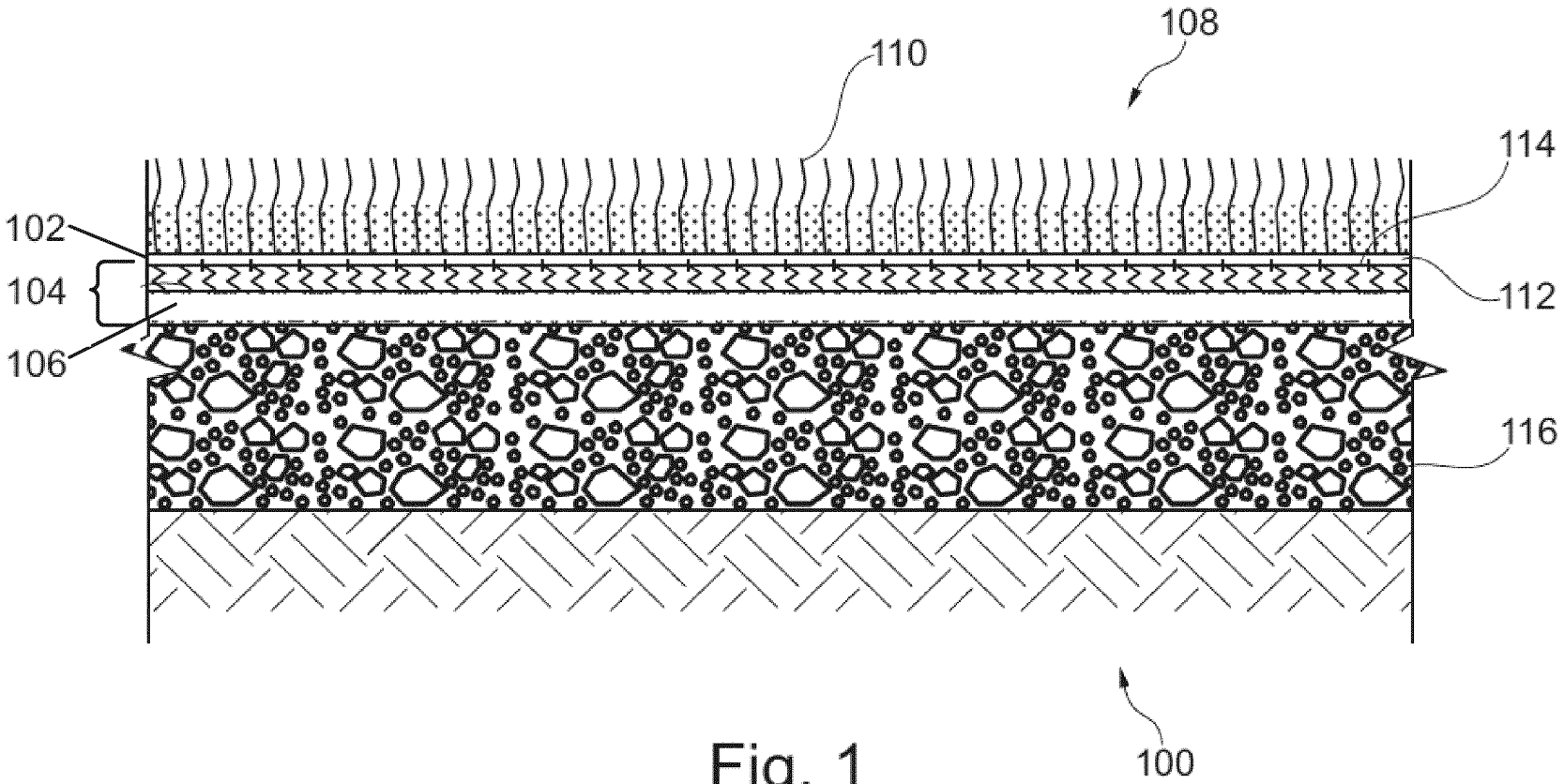
FIG. 1 is a cross-section of an artificial turf system, according to an exemplary embodiment of the invention.

Embodiments of the invention may have the advantage that it may not be necessary to remove an existing, worn-out artificial turf from a use site and transport the worn-out turf to a landfill. Thus, contrary to state-of-the art approaches for installing a new artificial turf, no waste is produced, because the old, existing artificial turf is not replaced but rather re-used as an elastic base layer. This may reduce the costs of installing new artificial turf and may avoid waste.

Moreover, embodiments of the invention may allow using a new artificial turf with an infill layer, a backing and/or a pile height that is smaller than usual and that may be at least 5%, preferably at least 10% smaller than the height of the infill layer, the height of the backing or the pile height of the existing turf, respectively, because the existing artificial turf may already provide some elasticity to the whole artificial turf system. Thus, production costs may be reduced, because a thinner (and thus typically cheaper) new artificial turf can be used for providing an artificial turf system with a desired degree of elasticity. In accordance with embodiments of the invention the thickness of the backing and/or the level of infill and/or the pile height of the new artificial turf is between 40% and 100%, such as between 50% and 95% of the underlying existing artificial turf.

Including a geogrid may be particularly advantageous, because a stack of two artificial turf layers may be too elastic and soft and thus may constitute a biomechanical drawback for the players and/or may make the players tired due to a high level of dampening. The geogrid may distribute mechanical forces imposed e.g. by a ball or by players of a soccer or rugby game over a large area of the underlying existing artificial turf that is underneath the new artificial turf. Thus, the rigidity of the geogrid provides at least some level of compensation as regards the increased dampening and may thus ensure that the players are not tired too quickly and may reduce the risk of sprained ankles and knees.

A "pile height" as used herein is the height of artificial turf fibers measured from the top surface of the backing to the top of the artificial turf.

A "geogrid" as used herein is a grid made of synthetic material that is adapted to reinforce soils and similar materials. Compared to soil, geogrids are strong in tension. This fact allows a geogrid to transfer forces to a larger area of soil than would otherwise be the case.

According to preferred embodiments, the ribs of the geogrids are stiff. This means that the geogrid is not a geotextile. According to preferred embodiments, also the junctions of the geogrid are stiff. The junctions are regions of the geogrid where the longitudinal and transverse ribs meet and are connected. They are sometimes called "nodes".

According to some embodiments, the geogrid is an "unitized geogrid" or "homogeneous geogrid", or more commonly referred to as "punched and drawn geogrid". According to other embodiments, the geogrid is made by laser or ultrasonically bonding together polyester or polypropylene rods or straps in a gridlike pattern.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

FIG. 1 is a cross-section of an artificial turf system 100, according to an exemplary embodiment of the invention. The artificial turf system 100 comprises an existing artificial turf 102, including a plurality of existing artificial turf fibres 104 and an existing artificial turf backing layer 106 configured to carry the plurality of existing fibres 104, a new artificial turf 108 comprising a plurality of artificial turf fibres 110 and an artificial turf backing layer 112, and a geogrid 114 positioned between the existing artificial turf 102 and the new artificial turf 108. As illustrated, the artificial turf system 100 is placed on, or is otherwise supported by, an existing base 116. The existing base 116 may be soil, concrete, wood, or any other types of supporting platforms that could be configured to support the artificial turf system 100 for its intended use.

A geogrid can be geosynthetic material used to reinforce soils and similar materials. Compared to soil, geogrids are strong in tension. This fact allows a geogrid to transfer forces to a larger area of soil than would otherwise be the case.

Geogrids are commonly made of polymer materials, such as polyester, polyvinyl alcohol, polyethylene or polypropylene. They may be woven or knitted from yarns, heat-welded from strips of material, or produced by punching a regular pattern of holes in sheets of material, then stretched into a grid.

According to embodiments, the backing layer of the existing artificial turf 102 comprises an elastic backing configured to fix the plurality of existing artificial turf fibres. The backing layer 112 of the new artificial turf 108 also comprises an elastic backing 304. In some embodiments, the height of the backing 304 of the new artificial turf is at least 5%, preferably at least 10% smaller than the height of the backing of the existing artificial turf.

In some embodiments, the pile height of the new artificial turf is at least 5%, preferably at least 10% smaller than the pile height of the existing artificial turf.

According to embodiments, the existing artificial turf 102 comprises an infill layer. The new artificial turf 108 may also comprises an infill layer. In some embodiments, the height of the infill layer of the new artificial turf is at least 5%, preferably at least 10% smaller than the height of the infill layer of the existing artificial turf.

Said features may be beneficial as a desired degree of elasticity may be achieved with a comparatively thin (and cheap) new artificial turf as the existing artificial turf already provides a cushioning effect.

According to some embodiments, the artificial turf system is free of an elastic layer made from a hardened polyurethane-rubber-granule mixture. Such layers typically consist of a hardened polyurethane-rubber-granule mixture. It has been observed that such an additional layer may not to be necessary, because an artificial turf system comprising a combination of two artificial turf layers and a geogrid has been observed to be sufficiently rigid as well as elastic for being used in many types of sports fields and play grounds.

Figure 2:
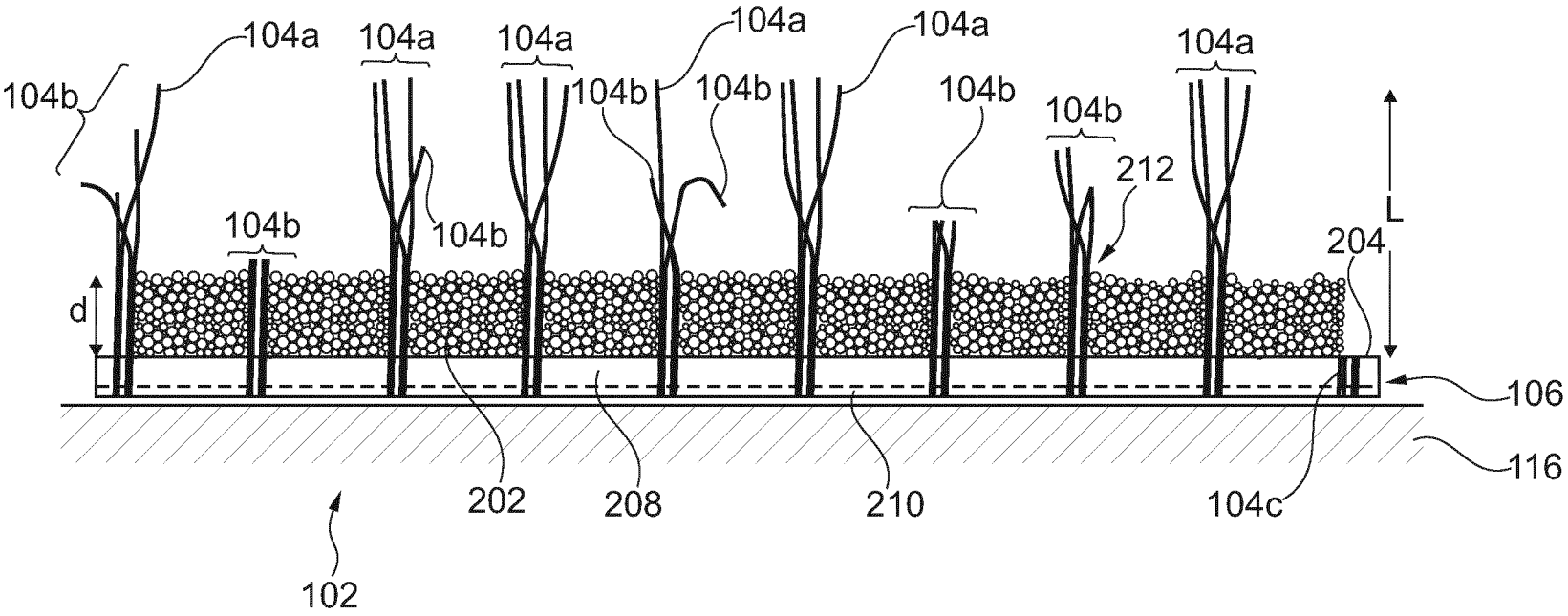
(Prior art) Fig. 2
FIG. 2 is a cross-section of the existing artificial turf illustrated in FIG. 1, according to the prior art.

FIG. 2 is a cross-section of the existing artificial turf 102 illustrated in FIG. 1, according to the prior art. The existing artificial turf 102 comprises the plurality of existing artificial turf fibres 104 and the existing artificial turf backing layer 106 configured to carry the plurality of existing fibres 104. The existing artificial turf 102 may also comprise an existing infill 202 located on a top 204 of the existing artificial turf backing layer 106, and although an average depth d for the existing infill 202 is indicated as constant, the depth d may vary from zero to a value L (i.e., an original pile height of the fibers) dependent upon the condition of the existing artificial turf 102.

The artificial turf backing layer 106 comprises a carrier layer 208, e.g. a carrier mesh, and may also comprise the backing, e.g. a latex-based or polyurethane (PU)-based backing (not shown), for securely binding the artificial turf fibers in the backing layer. If the existing artificial turf 102 does not include a backing, the artificial turf fibers 104 may be woven into the carrier layer 208 of the artificial turf layer 106. Likewise, interwoven artificial turf fibers can constitute the carrier layer. The existing artificial turf 102 can be attached to the existing base 116 by an optional adhesive layer 210. As is known in the art, the existing artificial turf fibers 104 may be carried by the carrier layer 208 of the artificial turf backing layer 106. The optional adhesive layer 210 may serve to securely bind the existing artificial turf to the base 116. Various types of glues or adhesives could be used for the adhesive layer 210.

The artificial turf fibers 104 of the existing artificial turf 102 may comprise any combination of intact fibers 104*a*, shown as extending a distance L above a top surface 204 of the artificial turf backing layer 106, partially intact fibers 104*b* comprising fibers that have been broken or damaged in some manner, and which do not extend the distance L above the top surface 204 of the backing layer 106, and non-intact fibers 104*c*, which do not extend above the top surface 204 of the backing layer 106. Instead of or in addition to the adhesive layer 210, the existing artificial turf may comprise a backing, e.g. a thin backing made of polyurethane or latex.

Furthermore, the existing infill 202 may comprise a loose collection of granulates arranged on the top surface 204 of the backing layer 106, thereby filling any spaces between lower portions 212 of the artificial turf fibers 104. Conventionally, the infill 202 is a rubber infill, but the scope of the invention covers all infill material, such as stones, plastics, including all types of polymers.

Figure 3:
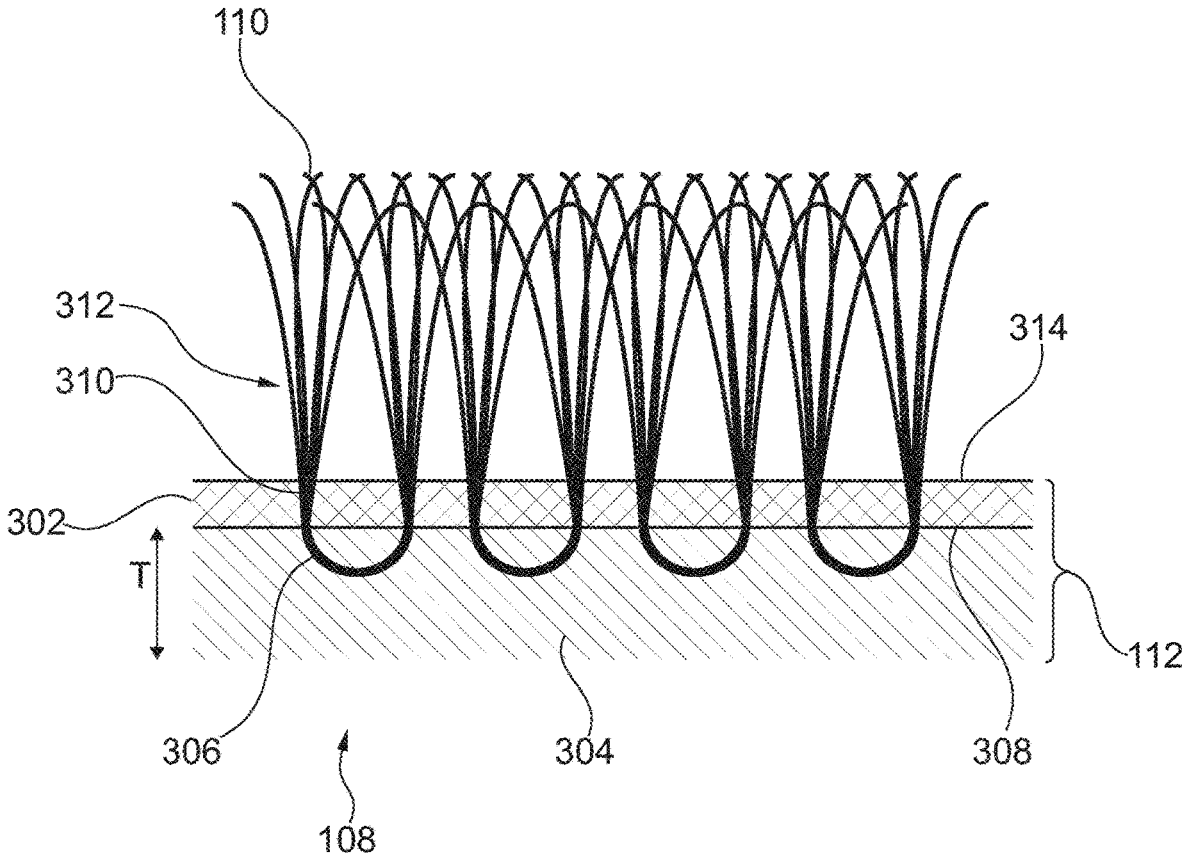
FIG. 3 is a cross-section of the new artificial turf illustrated in FIG. 1, according to an exemplary embodiment of the invention.

FIG. 3 is a cross-section of the new artificial turf 108 illustrated in FIG. 1, according to an exemplary embodiment of the invention. The new artificial turf 108 comprises the plurality of artificial turf fibres 110 and the artificial turf backing layer 112. As illustrated, the artificial turf backing layer 112 comprises a carrier structure 302, e.g. a carrier mesh, for carrying the new artificial turf fibers 110 and an optional elastic backing 304 configured to fix a portion of the fibers, as well as having a cushioning effect from the forces transmitted and received from above by players or other activities occurring on the artificial turf system 100. In some embodiments, the carrier mesh is formed by interwoven parts of the synthetic artificial turf fibers.

In one embodiment, the new artificial turf fibers 110 are arranged in the carrier structure 302, e.g. a textile plane, by means of tufting. Tufting is a type of textile weaving in which an artificial turf fiber (that may be a monofilament or a bundle of multiple monofilaments) is inserted in or through the carrier structure 302. After the inserting is done, as depicted in FIG. 3, first parts 306 of the artificial turf fibers 110, exposed to a bottom side 308 of the carrier structure 302, are mechanically fixed by the elastic backing 304, second parts 310 of the artificial turf fibers 110 are fixed by the carrier structure 302, and third parts 312 of the artificial turf fibers 110 are exposed to a top side 314 of the carrier structure 302.

In one embodiment, the backing 304 may be formed by mixing a binding agent, such as liquid polyurethane, with a filler, e.g. chalk, and/or rubber granulates, such as styrene-butadiene rubber (SBR) granulates or sulphur-cured ethylene propylene diene monomer (EPDM) rubber granulates, thereby forming a polyurethane fluid that solidifies into a PU layer. In other embodiments, the elastic binding agent may be latex. In other embodiments, the elastic binding agent may be a mixture of polyols and polyisocyanates that solidify into a polyurethane layer, or any other kind of fluid that is capable of solidifying after a pre-defined setting (or hardening) time into a solid layer or film. The fluid, also referred to as an elastic binding composition, may solidify into a film or layer by a drying process or by a chemical reaction resulting in a solidification of the fluid into a solid backing. Such a chemical reaction can be, for example, a polymerization.

In one embodiment, the elastic binding composition, while in liquid form, is applied to the bottom surface 308 of the carrier structure 302, e.g. at a factory where artificial turf is produced, and upon forming the elastic backing 304 upon solidification, fixes the first parts 306 of the artificial turf fibers 110.

As will be discussed further below in conjunction with FIG. 4, a polymeric geogrid 114 may introduce rigidity into the artificial turf system 100 that is normally desired for an athletic playing surface and that compensates the strong cushioning effect of the two artificial turf layers. However, the geogrid may also increase the risk of injuries, in particular where strands of the grid cross. However, as the grid is placed in-between an existing artificial turf layer and a new artificial turf layer, the rigidity of the grid is mitigated and the risk of injuries is reduced without adding cushioning layers in addition to the new artificial turf on top of the geogrid 114. Thereby, a system 100 is provided that not only distributes mechanical forces imposed by the players more evenly, but also protects the players from injuries. Thus, embodiments of the invention provide for a "sandwich" structure comprising a geogrid between two layers of artificial turf that represents a desirable compromise between rigidity and softness. Preferably, embodiments of the system 100 have drainage holes or other means for providing an effective drainage of water. They offer an effective manner of providing for a level playing surface, but also provide for a playing surface that has enough cushion to simulate real grass playing surfaces. In other words, the existing artificial turf 102 provides an additional cushioning effect, thereby mitigating the use of a polymeric geogrid, such as geogrid 114, in the artificial turf system 100, without increasing manufacturing or installation costs. In fact, the costs of installing a new artificial turf are typically reduced, as waste is avoided and the new artificial turf can be thinner and have smaller cushioning capabilities as normally required. Preferably, the backing of the existing turf structure and/or the backing of the new artificial turf is elastic. For example, at least the backing of the existing artificial turf and/or the backing of the new artificial turf can comprise PU or latex.

According to some embodiments (not shown), the new artificial turf 108 comprises an infill layer. The infill layer of the new artificial turf can be made of the same or different materials as described for the existing artificial turf layer. In some embodiments, the height of the infill layer of the new artificial turf is smaller than the height of the infill layer of a standard artificial turf and/or of the existing artificial turf. For example, the height of the infill layer of the new artificial turf can be below 2 cm, or even below 1 cm or even smaller. Thus, the new artificial turf may comprise no or only a thin infill layer. It has been observed that—thanks to the cushioning effect of the existing artificial turf layer, the infill layer of the new artificial turf 108 can be thinner than in state of the art system without increasing the risk of injuries of the players. The magnitude of the cushioning effect provided by the existing layer may depend on the thickness of the existing artificial turf, in particular on the thickness of the infill layer 202 of the exiting turf. In some embodiments, in particular in embodiments where the existing artificial turf is highly elastic and has strong cushioning effects, the new artificial turf is free of any infill, i.e., the infill layer of the new artificial turf has a height of "0". Placing the geogrid and the new turf on top of an existing turf may thus reduce installation costs, as the cushioning effect of the existing turf may be sufficient to compensate the rigidity of the geogrid without adding additional fillers on top of the new artificial turf.

Figure 4:
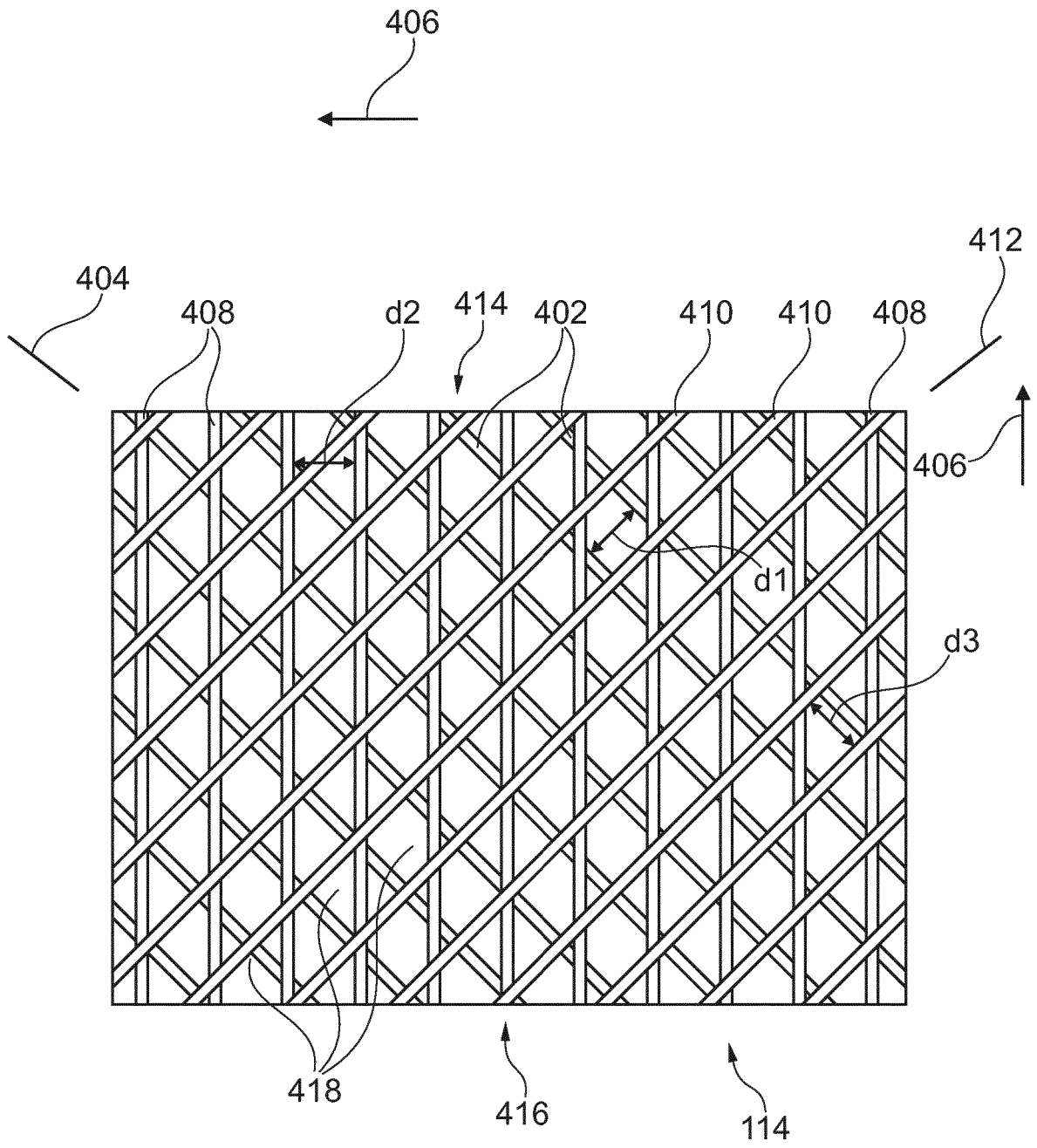
FIG. 4 shows a cross section of the geogrid layer illustrated in FIG. 1, according to an exemplary embodiment of the invention.

FIG. 4 shows a cross section of the geogrid layer 114 illustrated in FIG. 1, according to an exemplary embodiment of the invention. As illustrated, the geogrid 114 comprises three overlaying grid planes, including a first grid plane having a first plurality of strands 402 running parallel to each other and parallel to a first diagonal 404 with respect to a y direction 406, and spaced a distance d1 apart, a second grid plane place on top of the first grid plane, having a second plurality of strands 408, running parallel to each other and parallel to the direction y 406, and spaced a distance d2 apart, and a third grid plane place on top of the second grid plane, having a third plurality of strands 410 running parallel to each other and parallel to a second diagonal 412 with respect to they direction 406, and spaced a distance d3 apart. However, the scope the invention covers any number of overlaying grid planes, stacked one upon the other.

In one embodiment, each strand of the plurality of stands is made from extruded polypropylene or polyethylene material, however the plurality of the strands may comprise any type polymer, and thus may also be generally referred to as polymeric strands. Thus, in one embodiment of the invention, the geogrid 114 is a polymeric geogrid. Furthermore, each strand of the plurality of strands of the respective grid planes may have a constant cross section (i.e., area) (not shown) as measured along a length of each strand, thereby rendering the three grid planes to be coplanar with each other. A length of a strand is defined to be the longitudinal length, or in other words, the largest dimension of any strand.

In another embodiment of the invention, cross sections of each strand of the plurality of strands of one or more of the grid layers may vary as measured along the length of each strand. For example, and by way of an exemplary embodiment, the cross section of each second strand 408 of the plurality of second strands 408 of the second grid varies along the length of each strand (i.e., varies in the y-direction 406), such that the cross section of each second strand 408 increases as y increases. Thus, in this embodiment, top surfaces of the second and third grid layers are coplanar with each other, but are not coplanar with a top surface of the first grid. Thus, if the geogrid 114 is resting on a horizontal surface (not shown), then although the top surface of the first grid layer is coplanar with the horizontal surface, the top surface of the geogrid, which is the top surface of the third grid layer, is not coplanar with the horizontal surface, but is titled such that a first edge 414 of the top surface of the geogrid 114 is higher than a second opposite edge 416 of the top surface of the geogrid 114.

Thus, different geogrids can be designed to have different tilts and different degrees of tilt, with respect to a horizontal plane or surface, such that a top surface of the geogrid 114 will be horizontal after being placed upon a non-level (i.e., non-horizontal) existing artificial turf 102. More specifically, a geogrid 114 may include two or more grid layers, where one or more of the two or more grid layers may be comprised of parallel strands having non-uniform cross sections as measured along the lengths of the strands, for presenting a horizontal flat surface for reception of the new artificial turf 108 when being placed on top of an uneven, or tilted (with respect to a horizontal plane) existing artificial turf 102.

In addition to providing a technique to offer a horizontal surface for reception of the overlaying new artificial turf 108, the geogrid 114 comprises openings 418 created between the strands of the grid layers to provide an effective drainage pathway for water, thereby providing a system of draining water not only downward from above, but may also enable water to drain more effectively to laterally edges of the artificial turf system 100.

Thus, according to embodiments, the geogrid comprises two or more polymeric grid layers, wherein each polymeric grid layer of the two or more polymeric grid layers are formed of a plurality of polymeric strands 404, 408, 410 arranged parallel and having an associated fixed width between pairs of neighboring parallel polymeric strands, and wherein the two or more polymeric grid layers are arranged on top of each other such that each polymeric strand of the plurality of polymeric strands crosses at least one other polymeric strand of the plurality of polymeric strands. In some example embodiments, the two or more polymeric grid layers are arranged on top of each other such that each polymeric strand of the plurality of polymeric strands crosses at least one other polymeric strand of the plurality of polymeric strands for forming a plurality of openings 418 through the geogrid.

According to embodiments, a cross section of each polymeric strand of the plurality of polymeric strands of each polymeric grid layer is constant as measured along a length of said each polymeric strand.

However, according to preferred embodiments, a plane, level base for the new artificial turf is provided by preprocessing the existing artificial turf, e.g. by mechanically leveling the old infill and/or by supplying additional infill material to the infill layer of the existing artificial turf before the geogrid is applied on top of the existing artificial turf.

Figure 5A:
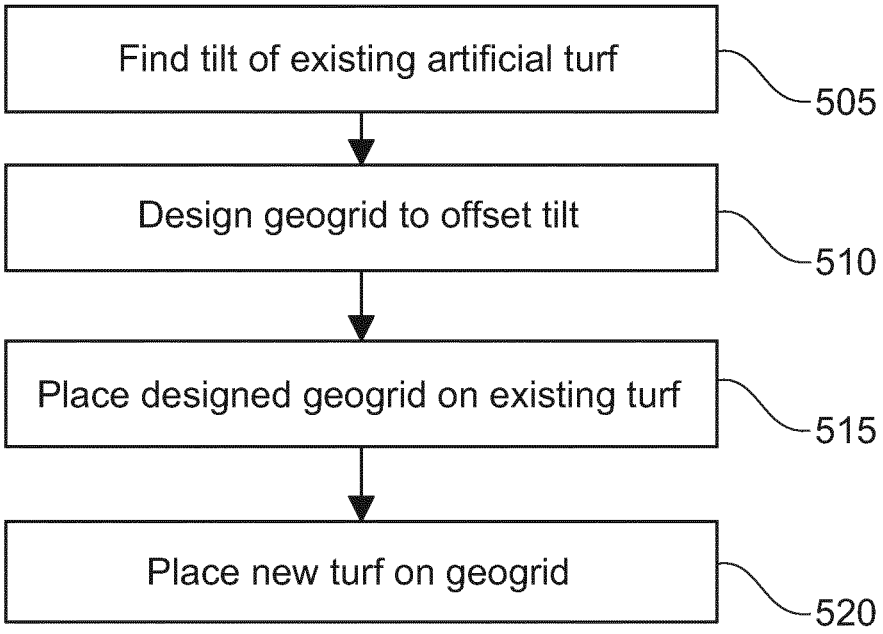
FIGS. 5*a*, 5*b* show two alternative methods of manufacturing the artificial turf system illustrated in FIG. 1, according to a respective embodiment of the invention.

FIG. 5*a* shows a method of manufacturing the artificial turf system 100 illustrated in FIG. 1, according to an exemplary embodiment of the invention. In optional step 505, position measurements are made to a surface of an existing artificial turf 102, with for example, instruments typically used for land surveying, or alternatively with laser light, or alternatively with a GPS device, to determine 3D spatial coordinates, for example, of the existing artificial turf 102. In one embodiment, the spatial coordinates are analyzed to generate a value for the tilt of the existing artificial turf with respect to a horizontal plane (e.g., with respect to a horizontal plane that has a normal vector (i.e., a vector perpendicular to the horizontal plane) that is parallel to a local gravitational vector).

In optional step 510, a geogrid 114, preferable of polymeric composition, is designed and produced to offset (i.e., mitigate) the tilt of the existing artificial turf 102, such that when placed upon the existing artificial turf 102, a top surface of the geogrid 114 is coplanar with the horizontal plane. In one embodiment, the geogrid includes two or more grid layers, where one or more of the two or more grid layers may be comprised of parallel strands designed to have non-uniform cross sections as measured along the lengths of the strands, for presenting a horizontal flat surface for reception of the new artificial turf 108 when being placed on top of the tilted existing artificial turf 102.

In step 515, the geogrid 114 is placed on top of the existing artificial turf 102.

According to some embodiments, the placing of the geogrid on the existing artificial turf is performed such that the geogrid is in direct contact with the existing artificial turf. This means that there may be no intermediate step of adding any further intermediate layer between the existing turf and the geogrid. This may accelerate the construction of the artificial turf structure.

In step 520, a new artificial turf 108 is placed on top of the geogrid 114.

According to some embodiments, the placing of the new artificial turf on the geogrid is performed such that the geogrid is in direct contact with the backing layer of the new artificial turf. This means that there may be no intermediate step of adding any further intermediate layer between the geogrid and the new artificial turf. This may further accelerate the construction of the artificial turf structure.

Figure 5B:
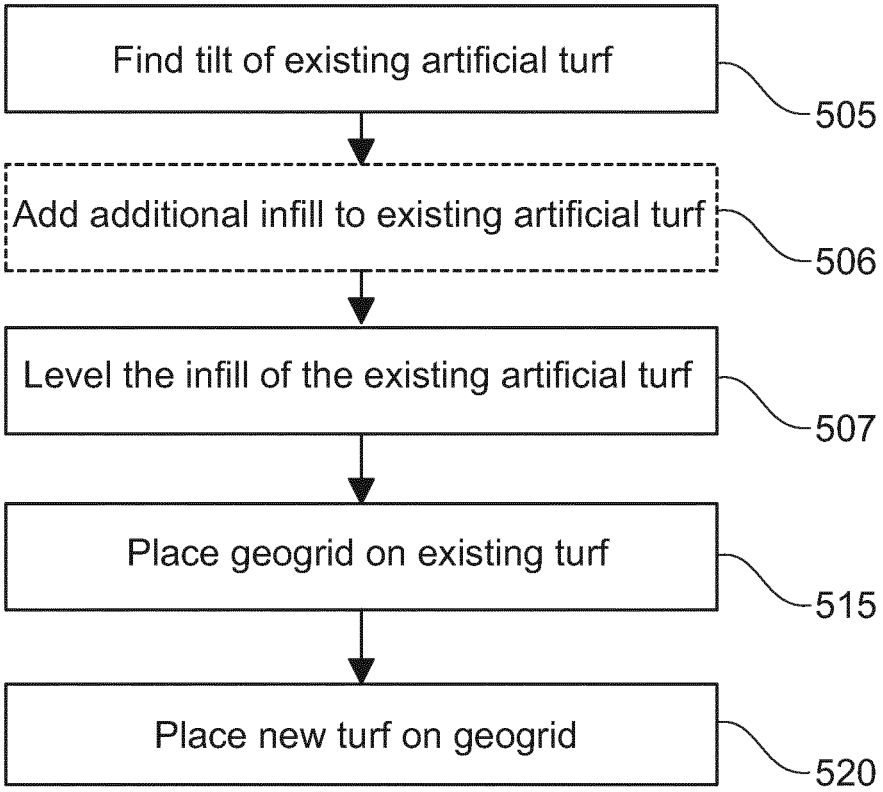

The new artificial turf 108 comprises a plurality of artificial turf fibres 110 and an artificial turf backing layer 112. The artificial turf backing layer 112 comprising a carrier structure 302 configured to carry the plurality of artificial turf fibres 110 and an elastic backing 304 configured to fix the plurality of artificial turf fibres 110, and to provide a cushioning effect for mitigating any rigidity introduced into the artificial turf system 100 by the geogrid 114. In one embodiment, the new artificial turf 108 is placed on top of the geogrid 114 such that the elastic backing 304 is adjacent to the geogrid 114. FIG. 5*b* shows a method of manufacturing the artificial turf system 100 illustrated in FIG. 1, according to a preferred embodiment of the invention. Some steps are identical to the steps described already for the embodiment depicted in FIG. 5*a* and will not be repeated. However, instead of designing the geogrid, in an optional step 506, additional infill material, e.g. rubber granules, are added to the existing artificial turf. For example, the additional infill material can be added manually or by a machine and can be added selectively to those regions in the existing artificial turf where a depression was observed.

In step 507, the infill of the existing artificial turf and also any additional infill material added in the optional step 505 is leveled, e.g. by means of a scraper or any other suited leveling device. Then, steps 515 and 520 are performed as described above, whereby the geogrid can be a standard geogrid having a uniform height.

The invention claimed is:

1. An artificial turf system, comprising:

a used artificial turf, comprising a plurality of used artificial turf fibres and a used artificial turf backing layer configured to carry the plurality of used artificial turf fibres;

an unused artificial turf comprising a plurality of artificial turf fibres and an artificial turf backing layer, said artificial turf backing layer comprising a carrier structure configured to carry the plurality of artificial turf fibres; and a geogrid positioned between the used artificial turf and the backing layer of the unused artificial turf, the geogrid including two or more grid layers, wherein one or more of the two or more grid layers each includes parallel strands having non-uniform cross sections as measured along lengths of the parallel stands, each of the two or more grid layers having a top surface, wherein the non-uniform cross sections as measured along the lengths of the parallel strands of each of the one or more of the two or more grid layers result in the top surface of each of the one or more of the two or more grid layers being tilted with respect to a horizontal plane.

2. The artificial turf system according to claim 1, wherein the used artificial turf further comprises used infill positioned between the plurality of used artificial turf fibres.

3. The artificial turf system according to claim 1, wherein the geogrid comprises a polymeric geogrid.

4. The artificial turf system according to claim 1, wherein the backing layer of the unused artificial turf and of the used artificial turf comprises a backing made of latex or polyurethane.

5. The artificial turf system according to claim 1, wherein the unused artificial turf is free of an infill.

6. The artificial turf system according to claim 1, wherein the unused artificial turf comprises an infill layer, the height of the infill layer of the unused artificial turf being at least 5% smaller than the height of the infill layer of the used artificial turf.

7. The artificial turf system according to claim 1, wherein the backing layer of the used artificial turf comprises an elastic backing configured to fix the plurality of used artificial turf fibres and wherein the backing layer of the unused artificial turf further is free of an elastic backing.

8. The artificial turf system according to claim 1, wherein the backing layer of the used artificial turf comprises an elastic backing configured to fix the plurality of used artificial turf fibres and wherein the backing layer of the unused artificial turf comprises an elastic backing whose height is at least 5% smaller than the height of the backing of the used artificial turf.

9. The artificial turf system according to claim 1, wherein the pile height of the unused artificial turf is at least 5% smaller than the pile height of the used artificial turf.

10. The artificial turf system according to claim 1, wherein the artificial turf system is free of an elastic layer made from a hardened polyurethane-rubber-granule mixture.

11. The artificial turf system according to claim 1, wherein the geogrid is in direct contact both with the used artificial turf and the backing layer of the unused artificial turf.

12. The artificial turf system according to claim 1, wherein the geogrid has a top surface, wherein the used artificial turf is tilted with respect to the horizontal plane, and wherein the non-uniform cross sections as measured along the lengths of the parallel strands of each of the one or more of the two or more grid layers result in the top surface of the geogrid being coplanar with the horizontal plane.

* * * * *